US012296373B2

(12) United States Patent
Grumm

(10) Patent No.: US 12,296,373 B2
(45) **Date of Patent: *May 13, 2025**

(54) CAN SEAMING APPARATUS

(71) Applicant: Oktober, LLC, Grand Rapids, MI (US)

(72) Inventor: Dennis Grumm, Grand Rapids, MI (US)

(73) Assignee: Oktober, LLC, Muskegon, MI (US)

( * ) Notice: Subject to any disclaimer, the term of this patent is extended or adjusted under 35 U.S.C. 154(b) by 507 days.

This patent is subject to a terminal disclaimer.

(21) Appl. No.: 17/497,719

(22) Filed: Oct. 8, 2021

(65) Prior Publication Data

US 2022/0097120 A1 Mar. 31, 2022

Related U.S. Application Data

(63) Continuation of application No. 16/156,742, filed on Oct. 10, 2018, now Pat. No. 11,141,774.

(51) Int. Cl.
*B21D 51/32* (2006.01)
*B21D 51/26* (2006.01)

(52) U.S. Cl.
CPC ..... *B21D 51/32* (2013.01); *B21D 51/2653* (2013.01); *B21D 51/2661* (2013.01)

(58) Field of Classification Search
CPC ..... B21D 51/2653; B21D 51/2661; B21D 51/30; B21D 51/32
See application file for complete search history.

(56) References Cited

U.S. PATENT DOCUMENTS 228,234 A * 6/1880 Walsh ..... B21D 51/32 413/31
228,235 A * 6/1880 Walsh ..... B21D 51/32 413/31
612,031 A * 10/1898 Gordon ..... B21D 51/32 413/31
789,406 A * 9/1905 Boldenweck ..... B21D 51/32 413/31
1,777,761 A * 10/1930 Nelson ..... B21D 51/32 413/31
1,983,081 A * 12/1934 Hopkins ..... B21D 51/32 413/39
2,370,169 A * 2/1945 Jacobs ..... B21D 51/32 413/31
3,902,438 A * 9/1975 Smith ..... B21D 51/32 413/37
11,141,774 B2 * 10/2021 Grumm ..... B21D 51/32

FOREIGN PATENT DOCUMENTS

KR 20180118967 A * 11/2018 ..... B21D 51/32

* cited by examiner

*Primary Examiner* — Jared O Brown
(74) *Attorney, Agent, or Firm* — The Watson IP Group, PLC; Jovan N. Jovanovic

(57) ABSTRACT

A can seaming apparatus including a frame, a can handling assembly, a can driving assembly and a seaming assembly. The can seaming apparatus is configured to seal a lid to a can through a double seam can seal. The can is positioned and clamped between an upper and a lower chuck. The can driving assembly spins the can and the upper and lower chucks about an axis. The seaming assembly includes two rollers mounted to a roller frame which pivots about an axis relative to the frame. The roller frame can be pivoted so as to selectively have the two rollers sequentially engage the can to form the necessary crimping operations.

17 Claims, 10 Drawing Sheets

CAN SEAMING APPARATUS

CROSS-REFERENCE TO RELATED APPLICATION

This present application is a continuation of U.S. patent application Ser. No. 16/156,742 filed on Oct. 10, 2018, entitled "Can Seaming Apparatus", and is related to, but does not claim priority from, U.S. Pat. App. Ser. No. 62/330,072 filed Apr. 30, 2016, entitled "Can Seaming Apparatus" and U.S. patent application Ser. No. 15/581,190, filed Apr. 28, 2017, entitled "Can Seaming Apparatus", the entire disclosure of each of which is hereby incorporated by reference in its entirety.

BACKGROUND OF THE DISCLOSURE

1. Field of the Disclosure

The disclosure relates in general to a container forming apparatus, and more particularly, to a can seaming apparatus that is configured to form the double seam can seal on a can. While not limited thereto, the apparatus is well suited for the application of a double seam can seal on a typical aluminum beverage can (such as what is known as a beer can). Of course, this is to be deemed exemplary and is not to be deemed limiting.

2. Background Art

The manufacture of cans is known in the art. For example, beverage cans are formed from a lower can portion and an upper can top. With a typical can configuration, the can includes an upper outward flange. The cover includes a cover curl that extends over the end of the flange and below the flange. In a first operation, a roller directs the cover between the flange and the body to form an initial crimp. Next, in a second operation, a second roller flattens the seam to complete the double seam can seal.

While equipment for coupling the upper can top to the can is known, current equipment has many drawbacks. First, much of the available equipment comprises larger equipment that is configured to continuously, and in an automated fashion, seal successive cans. Such equipment is not suitable or efficient for smaller batch production. Moreover, for small batch production, such equipment is too costly to purchase and operate.

Other solutions exist that are more well suited to smaller batch production. Nevertheless, such equipment also has drawbacks. In particular, some such equipment requires extensive training, and may be difficult to operate. Other such equipment, while suitable for smaller batch production, is nevertheless expensive to purchase and operate.

There remains a need for a small, efficient and cost effective can seaming apparatus.

SUMMARY OF THE DISCLOSURE

The disclosure is directed to a can seaming apparatus comprising a frame, a can handling assembly, a can driving assembly and a seam forming assembly. The can handling assembly is associated with the frame. The can handling assembly has a lower end can handling subassembly and an upper can handling subassembly. The lower can handling subassembly includes a lower chuck structurally configured to retain a lower rim of a blank of a can. The upper end can handling assembly includes an upper chuck structurally configured to retain an upper cap the can. The lower end can handling assembly further including a lower can positioning subassembly structurally configured to raise and lower the lower chuck toward and away from the upper chuck. The can driving assembly is structurally configured to rotate at least one of the upper chuck and the lower chuck. The seam forming assembly has a roller frame pivotably coupled to the frame through a roller frame pivot axle, a first roller rotatably coupled to the roller frame spaced apart from the roller frame pivot axle and a second roller rotatably coupled to the roller frame. The first and second rollers are on opposite sides of the roller frame pivot axle.

In some configurations, the lower can handling subassembly includes an overcenter mechanism to lock the lower chuck into an engaging configuration.

In some such configurations, the overcenter mechanism further includes an overcenter handle which is coupled through linkages to the lower chuck. The overcenter handle can be rotated relative to the linkages into the engaging configuration.

In some configurations, the overcenter mechanism further includes an adjustment mechanism structurally configured to adjust the position of the lower chuck relative to the upper chuck in the engaging configuration.

In some configurations, the driving assembly further includes a motor that is operably coupled to the upper chuck, to in turn, facilitate rotation thereof.

In some configurations, the upper chuck is rotatably coupled to the frame, in a fixed position.

In some configurations, the lower chuck and the upper chuck have a collinear axis of rotation.

In some configurations, the first roller, the second roller and the roller frame pivot axle are parallel to each other.

In some configurations, a rotation actuator extending from the roller frame.

In some configurations, the rotation actuator comprises a handle member.

In some configurations, the roller frame, the first roller and the second roller are substantially symmetrical about an axis that extends through the roller frame pivot axis.

In some configurations, the seam forming assembly further includes a rotation limiting assembly. The rotation limiting assembly includes a clockwise stop member mounted outboard of the first roller so that the first roller is between the clockwise stop member and the roller frame pivot axle, and a counterclockwise stop member mounted outboard of the second roller so that the second roller is between the counterclockwise stop member and the roller frame pivot axle.

In some configurations, each of the clockwise stop member and the counterclockwise stop member each comprise threaded fasteners engeagable with the roller frame. In such a configuration, threading of the same relative to the roller frame one of increases or decreases the pivoting of the roller frame.

In some configurations, the frame comprises a base with a central region, a first foot and a second foot extending therefrom, and, a central beam extending upwardly therefrom.

In some configurations, the motor is mounted to the central beam, and the upper mounting plate is fixedly coupled to the central beam.

In another aspect of the disclosure, the disclosure is directed to a method of operating a can seaming apparatus that includes the steps of: providing a can blank and a top cap; positioning the can blank on the lower chuck; positioning the top cap on the can blank; raising the lower chuck so that the top cap engages the upper chuck and the lower chuck reaches the engaging configuration; locking the lower chuck in the engaging configuration; actuating the driving assembly so as to rotate the lower and upper chucks and the can blank and top cap about an axis of rotation; pivoting a roller frame in a first direction to engage the can blank and top cap, with a first roller, to, in turn, deform at least one of the can blank and the can top; pivoting the roller frame in a second direction to engage the can blank and top cap with a second roller, to, in turn, deform at least one of the can blank and the can top; removing the can blank and top cap which define a formed can.

In some configurations, the first roller and the second roller pivot about the same axis of rotation.

In some configurations, the first roller and the second roller are spaced apart from each other to allow for approximately 60° and 200° of pivoting of the roller frame about an axis of rotation.

BRIEF DESCRIPTION OF THE DRAWINGS

The disclosure will now be described with reference to the drawings wherein.

DETAILED DESCRIPTION OF THE DISCLOSURE

Figure 1:
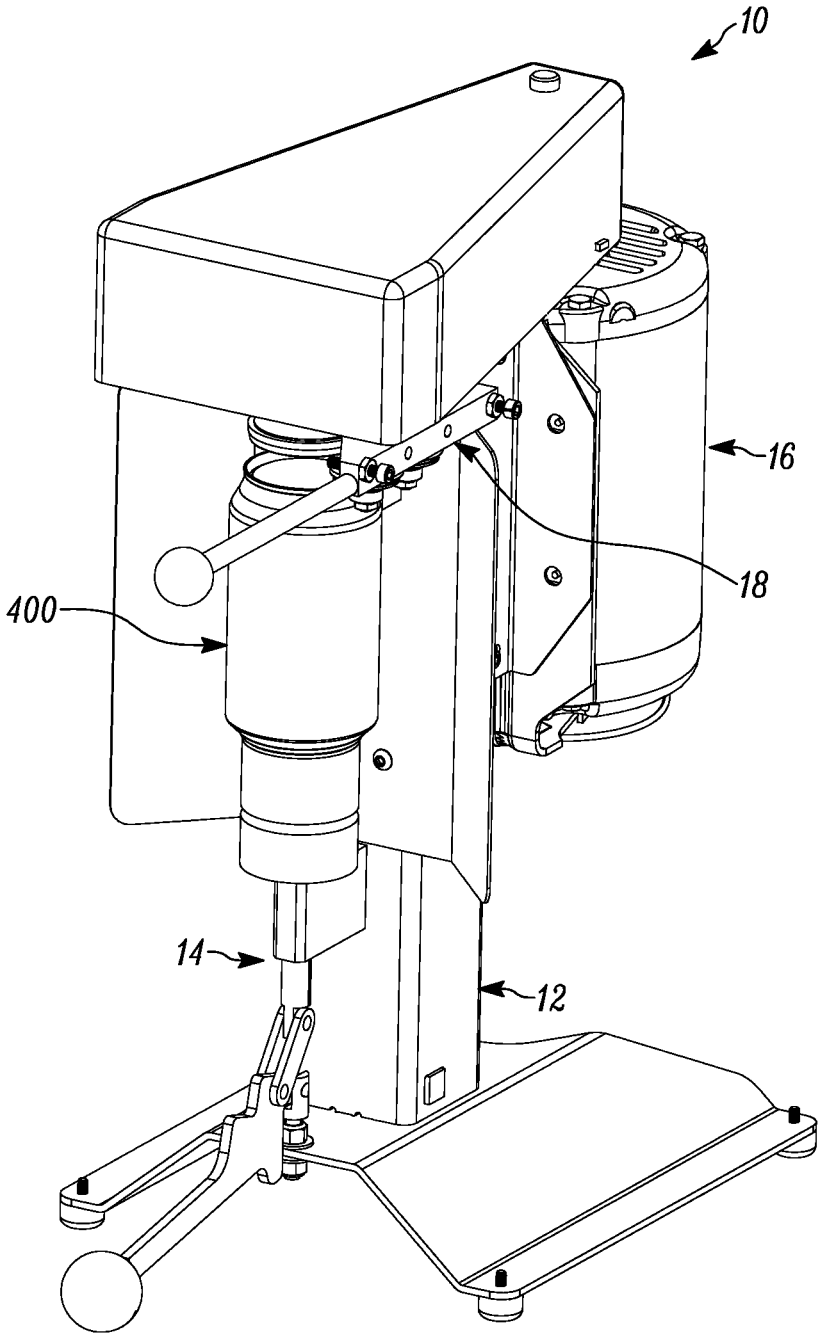
FIG. 1 of the drawings is a front, side perspective view of the can seaming apparatus of the present disclosure.
Figure 2:
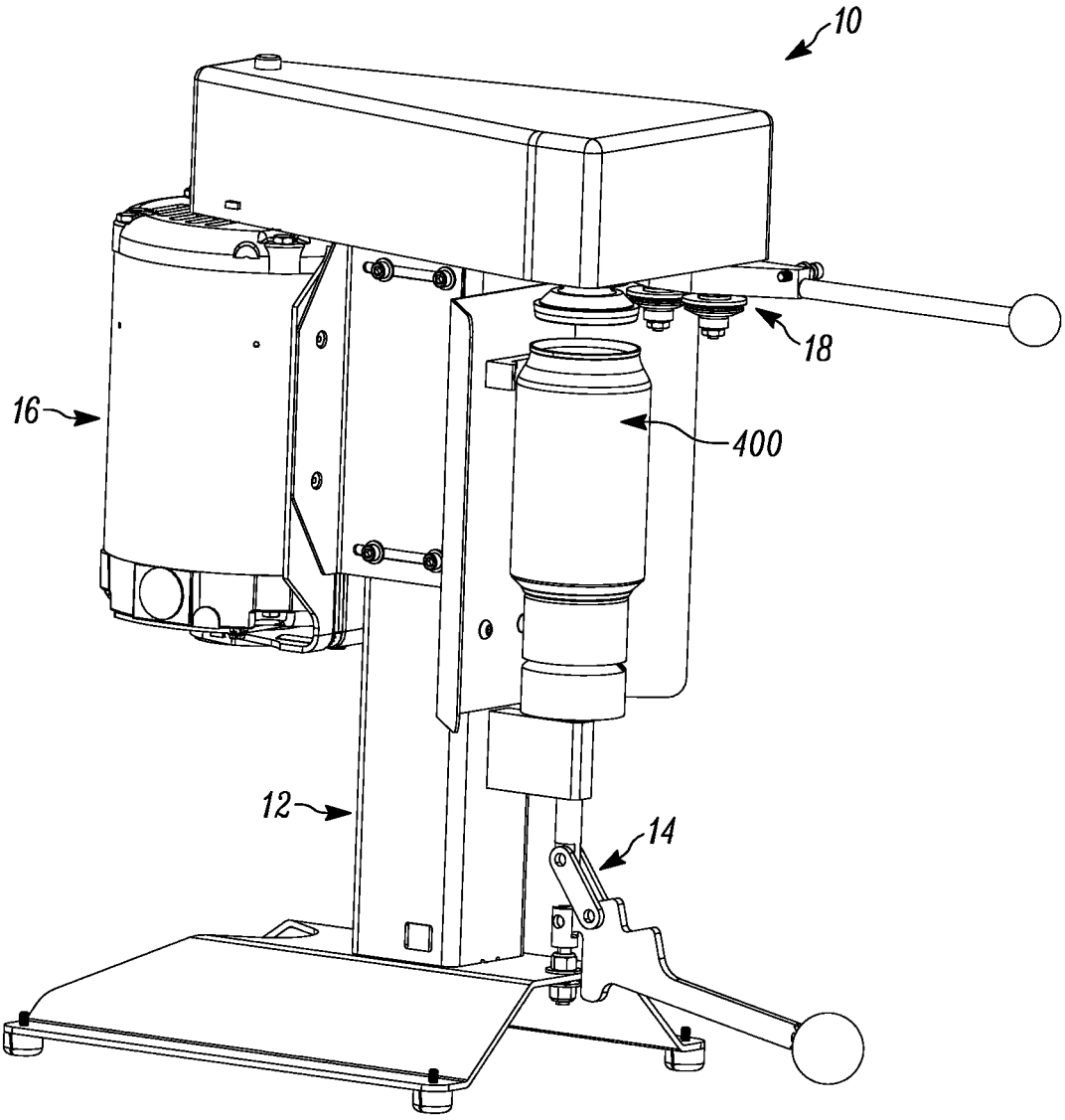
FIG. 2 of the drawings is a front, side perspective view of the can seaming apparatus of the present disclosure.

While this disclosure is susceptible of embodiments in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 11:
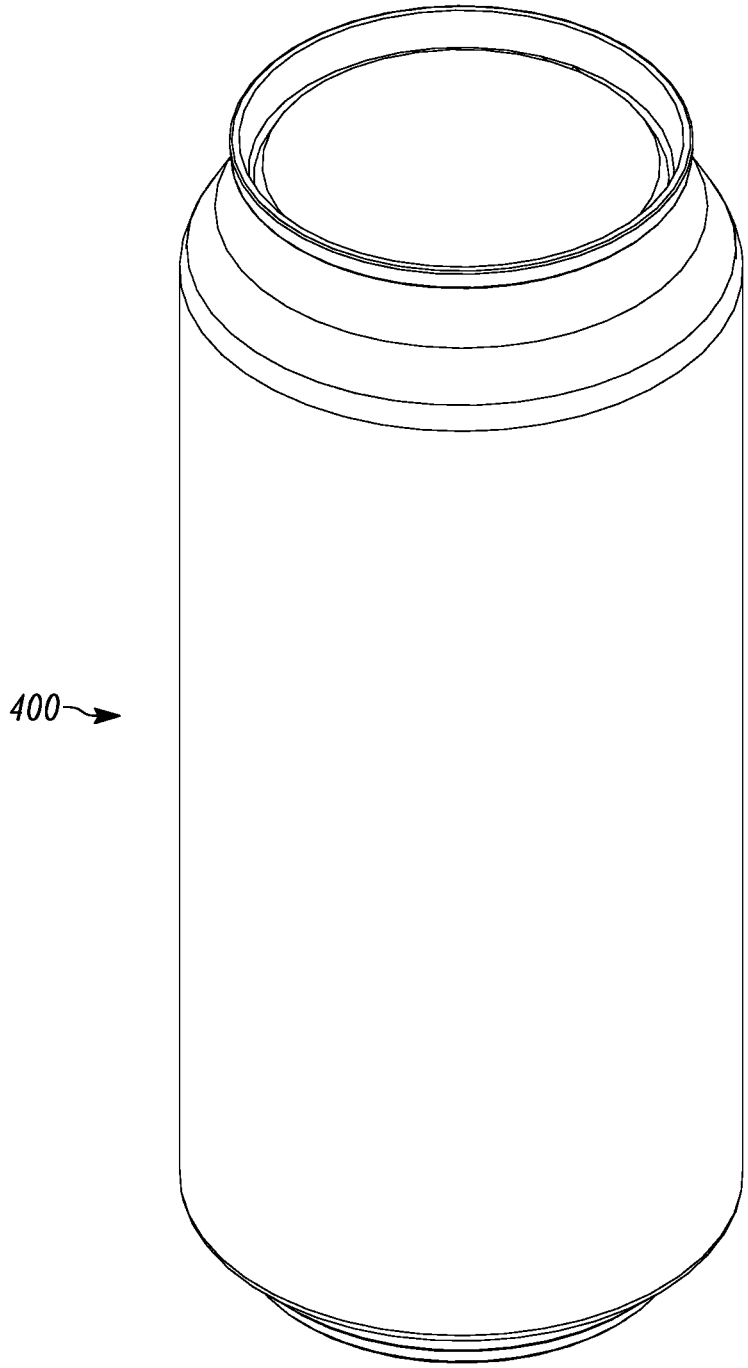
FIG. 11 of the drawings is a perspective view of a can blank having a cap thereon.

Referring now to the drawings and in particular to FIGS. 1 through 4, the can seaming apparatus is shown generally at 10. The can seaming apparatus includes frame 12, can handling assembly 14, can driving assembly 16 and seam forming assembly 18. The can seaming apparatus is configured to be manually operated (although automation is likewise contemplated with respect to the seam forming assembly). As set forth above, such a configuration allows for the inexpensive and efficient self-canning and sealing of cans, such as can 400 (FIG. 11), by an individual or a relatively small operation.

In the configuration shown, the frame 12 is shown as comprising base 20, central beam 22, motor mount 26 and upper mounting plate 28. The base 20 includes central region 21, first foot 23 and second foot 24. The first and second feet are spaced apart from the central region, and angled away in a downward direction therefrom. At opposing corners, adjustable bumpers are threadedly engaged with the feet to provide firm placement on an outside surface. The central region 21 is raised from the first and second feet and defines a back and a front.

The central beam 22 includes lower end 34 and upper end 36. In the configuration shown, the lower end is proximate the central region of base 20 and is coupled thereto. Also in the configuration shown, the central beam 22 has a generally square cross-sectional configuration and comprises a c-shaped beam structure.

A motor mount 26 is shown as comprising a pair of opposing angled members that are attached toward the upper end of the central beam 22. Of course, other configurations are contemplated as well. Also between the lower end and the upper end of the central beam, and proximate the front end thereof, is a can guard 35, with a can forming bracket 27 being mounted thereto opposite from the central beam.

The upper mounting plate 28 is shown as being coupled to the upper end of the central beam and includes a top surface 30 and a bottom surface 32. The bottom surface 32 includes a lower limit surface, which, as will be explained, provides a rotational limit for seam forming assembly 18. A cover may be positioned over the gears and the upper mounting plate.

Figure 4:
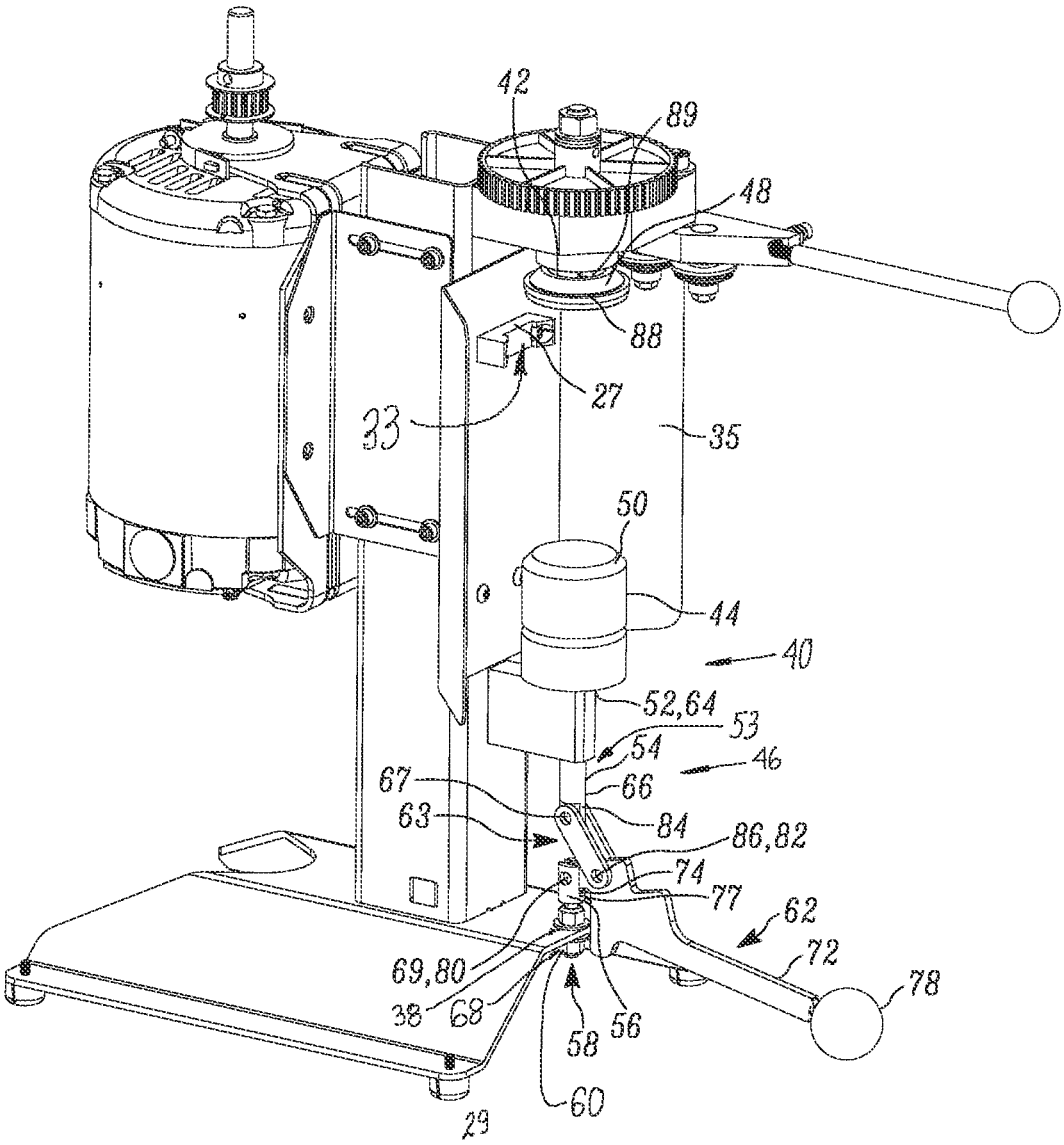
FIG. 4 of the drawings is a front, side perspective view of the can seaming apparatus, showing, in particular, a cover removed and exposing the transmission system.
Figure 5:
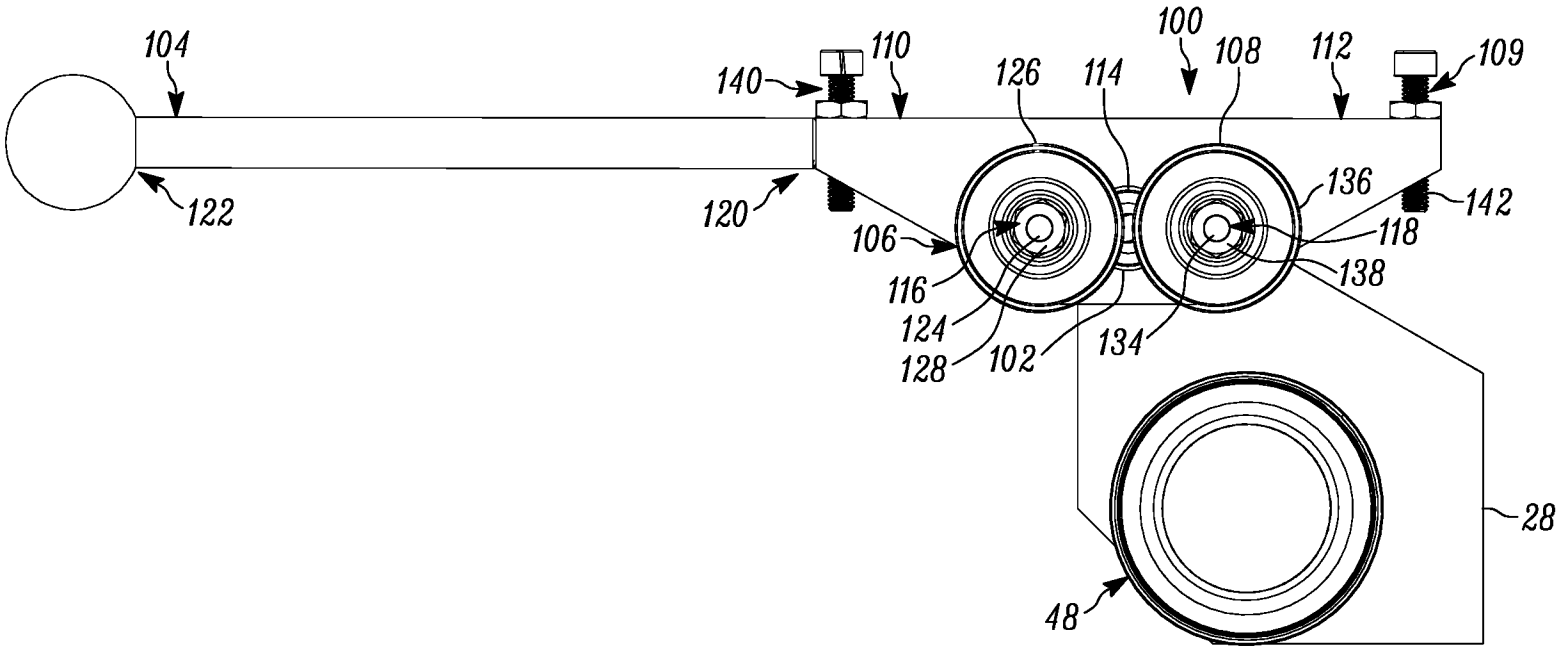
FIG. 5 of the drawings is a bottom plan view of the seam forming assembly coupled with the upper chuck and the upper mounting plate.
Figure 6:
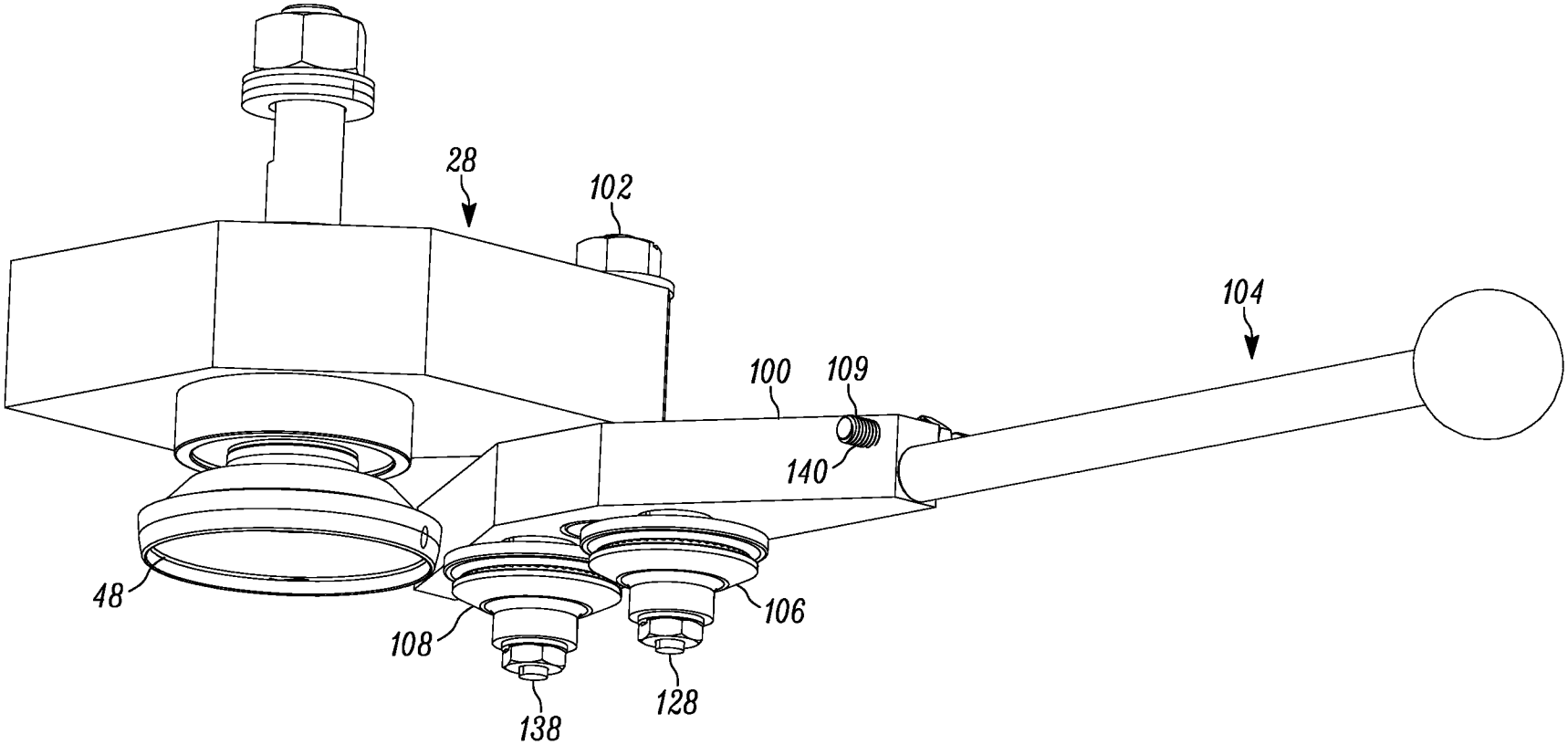
FIG. 6 of the drawings is a side perspective view of the components shown in FIG. 5.
Figure 7:
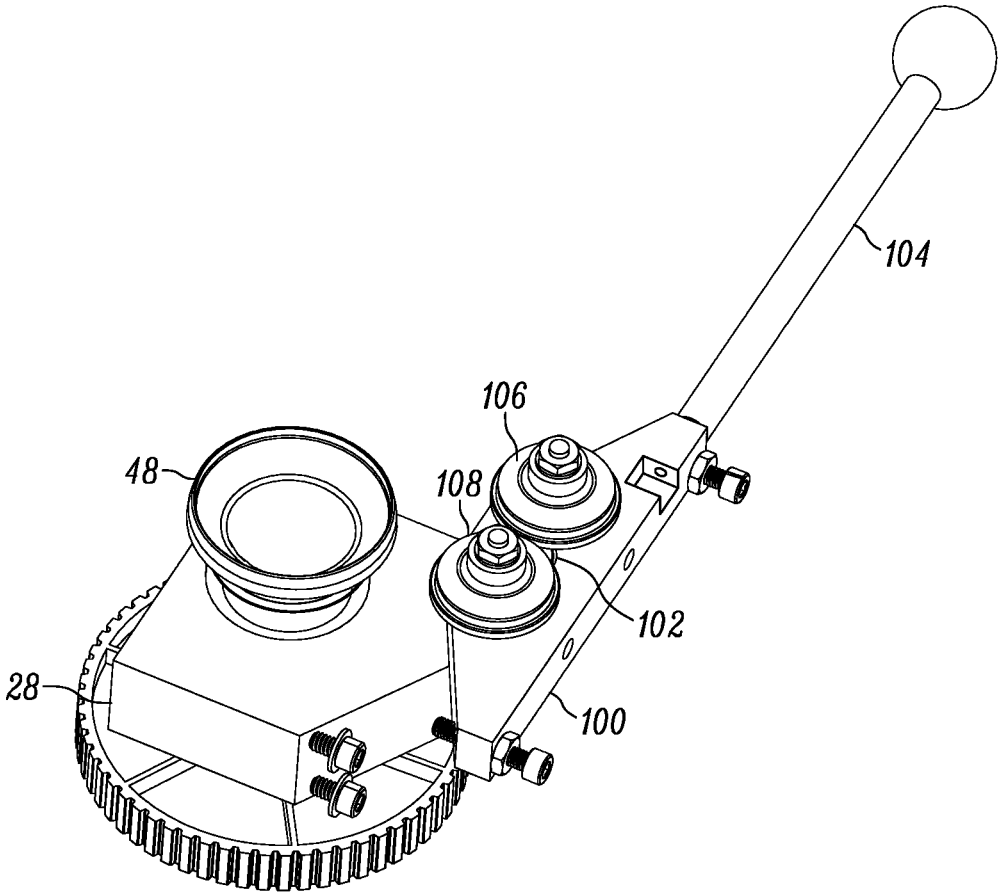
FIG. 7 of the drawings is a bottom perspective view of the components shown in FIG. 5, in a second position, wherein the roller frame is pivoted in a counterclockwise direction, engaging the second roller.
Figure 8:
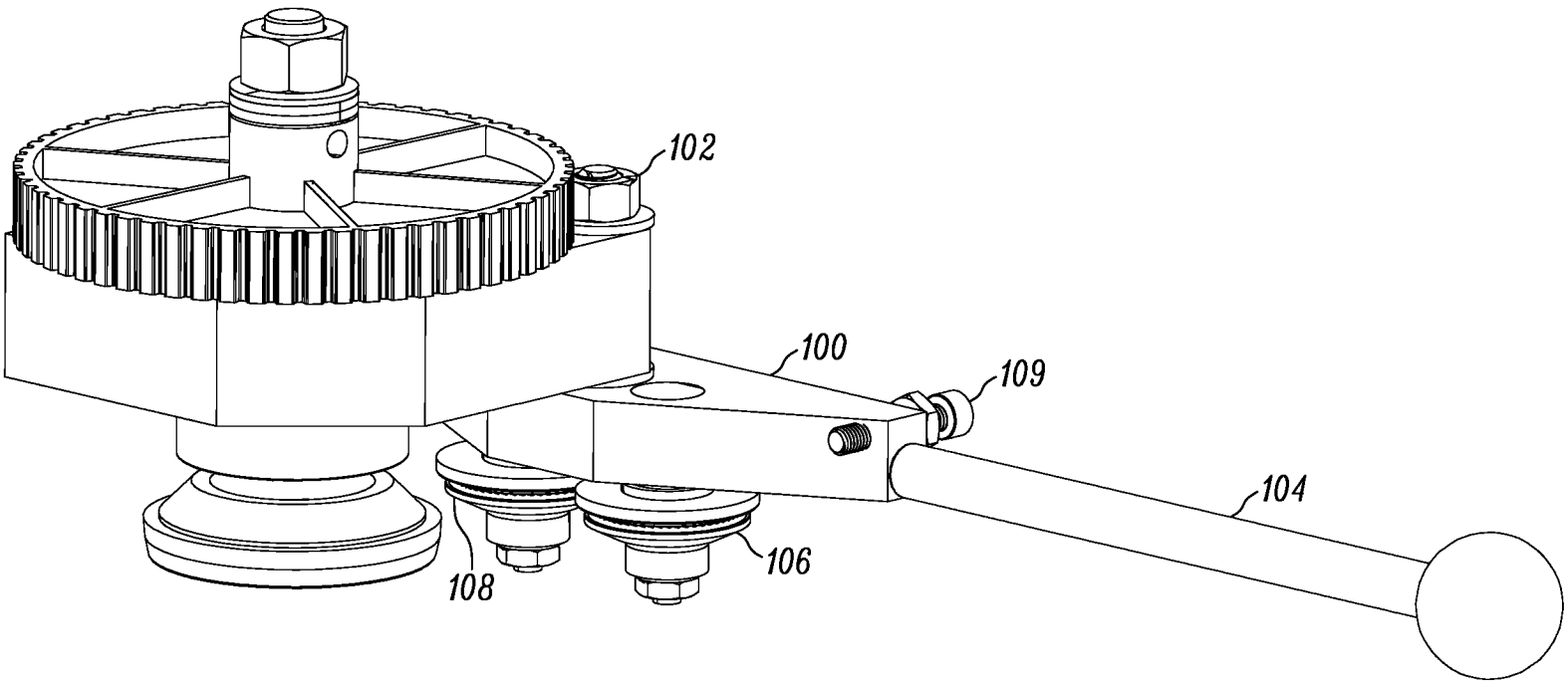
FIG. 8 of the drawings is a top perspective view of the components shown in FIG. 5, in a second position, wherein the roller frame is pivoted in a counterclockwise direction, engaging the second roller.
Figure 9:
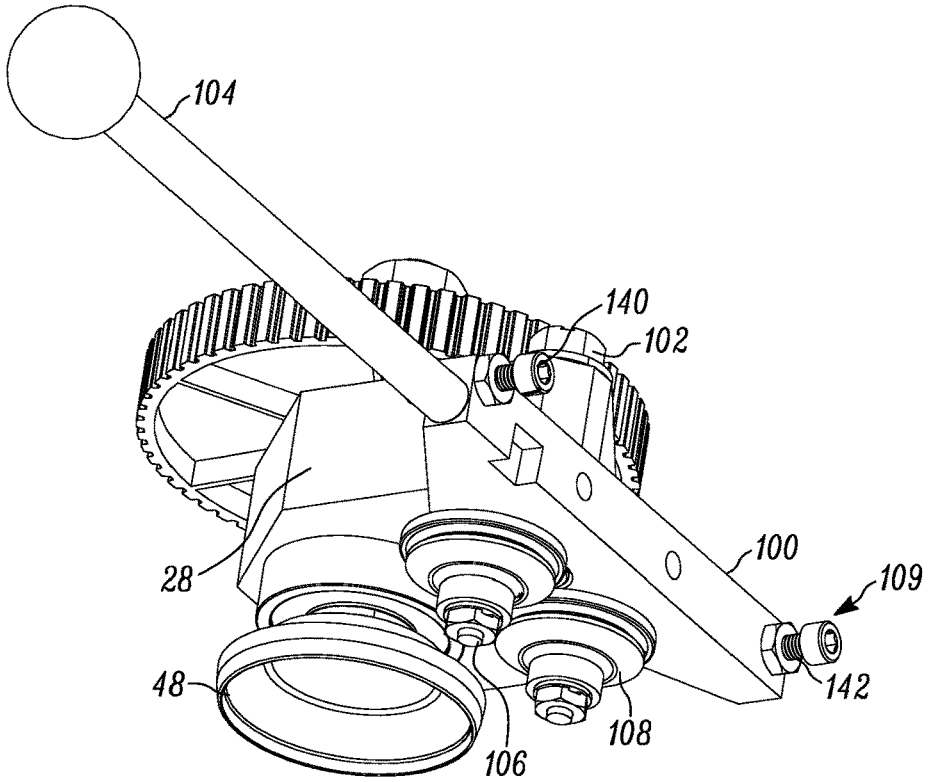
FIG. 9 of the drawings is a bottom perspective view of the components shown in FIG. 5, in a first position, wherein the roller frame is pivoted in a counterclockwise direction, engaging the first roller.
Figure 10:
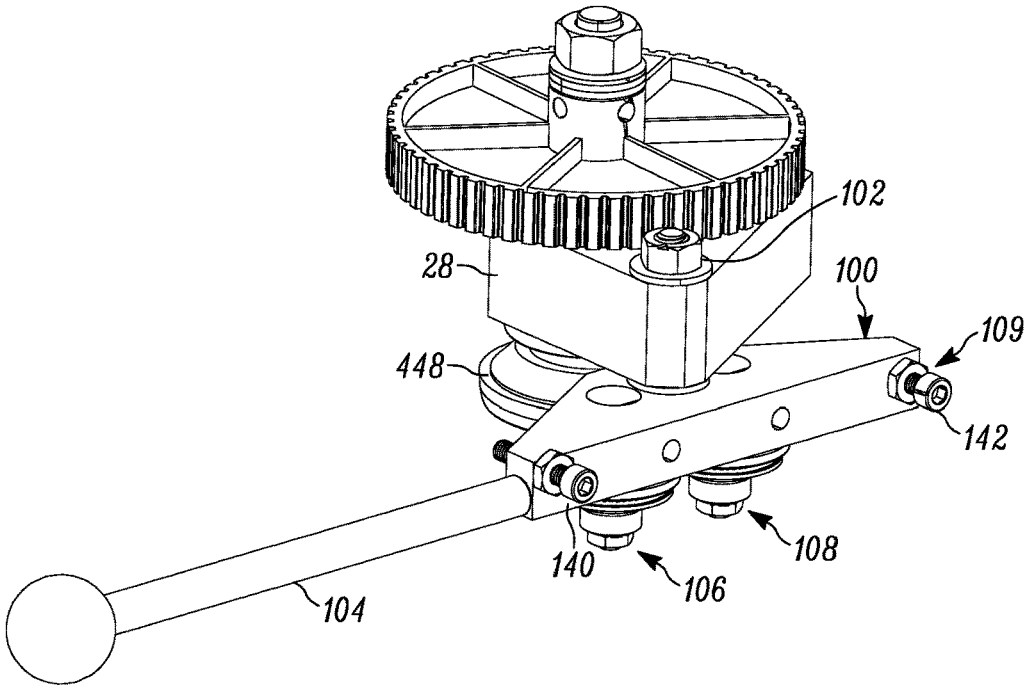
FIG. 10 of the drawing is a top perspective view of the components shown in FIG. 5, in a first position, wherein the roller frame is pivoted in a counterclockwise direction, engaging the first roller.

The can handling assembly 14 is shown in FIG. 4 as including lower end can handling subassembly 40 and upper end can handling subassembly 42. The lower end can handling subassembly 40 includes lower chuck 44, and lower can positioning subassembly 46. Lower chuck 44 includes upper surface 50 and lower axle opening 52. The axle opening 52 defines axis of rotation 53. The upper surface of the lower chuck 44 is configured to matingly engage the lower surface of a can blank, such as can blank 400. The can blank generally comprises a conventional, typically aluminum, can blank that has an outer lower rim with a generally outwardly concave, or domed configuration. The upper surface of the lower chuck is configured to engage with the outer lower rim and concave configuration so that the can positioned thereon rotates about its central axis which matches the central axis of the lower chuck. In the configuration shown, the can is merely placed on the lower chuck, and the lower chuck does not include gripping means or the like (although some type of gripping means are contemplated).

In more detail, the upper surface 50 includes an outer chamfer which facilitates the centering of the can 400 when positioned thereon. The chamfer can engage or direct/urge/push the can into the proper orientation on the lower chuck. The lower chuck may further include a biasing member (not shown) (which may comprise an internally mounted spring washer or wave spring) that biases the upper surface 50 toward the upper chuck. This allows for some biasing force when clamped through the overcenter mechanism.

The lower can positioning subassembly 46 includes upper push rod 54, lower clamp rod 56, adjustment mechanism 58, locking screw 60, overcenter handle 62 and linkage 63. The lower can positioning subassembly 46, in the configuration shown, comprises an overcenter mechanism which can slidably direct the lower chuck upwardly and downwardly and lock the same in the upper position. As will be explained below, such movement can lock, in a clamping manner, the can between the upper and lower chucks.

The upper push rod 54 includes first end 64 and second end 66. The first end 64 is coupled to the lower axle opening 52 of the lower chuck 44 and defines the axis of rotation of the lower chuck 44. The second end 66 includes axle 67 (or opening 67 configured to receive an axle so as to define an axis of rotation or pivotable coupling). The upper push rod 54 extends through upper bore 36 of the lower mounting plate 29. The lower clamp rod 56 includes first end 68 and second end 69. The lower clamp rod 56 extends through the lower bore 38 of the lower mounting plate 29. The lower clamp rod is positioned in the same axis as the upper push rod. The adjustment mechanism 58 interfaces with the central region of the base to make adjustments in the limits to the movement of the lower chuck.

The overcenter handle 62 includes arm 72 and lever portion coupling 74. The lever portion coupling 74 includes lower pivot connection 80 and upper pivot connection 82. The two pivot connections are spaced apart from each other. The arm extends outwardly therefrom and includes first end 77 that is proximate the two pivot connections and second end 78 which is spaced apart therefrom. The arm provides the leverage necessary to rotate the lever arm relative to the linkage and the lower clamp rod, as will be explained. The linkage 63 includes first pivot connection 84 and second pivot connection 86.

The overcenter mechanism is formed by coupling the lower pivot connection 80 of the lower portion coupling 74 of the overcenter handle 62 to the lower clamp rod 56. The linkage 63, and in particular, the first pivot connection 84 is coupled to the axle 67 of the second end of the upper push rod 54, and the second pivot connection 86 is coupled to the upper pivot connection 82 of the lever portion coupling of the overcenter handle. As the handle is rotated about the lower clamp rod, the upper push rod is directed in an upward direction relative to the lower mounting plate 29. At some point the handle member reaches a point at which further rotation is not permitted, at which time, the handle can be locked in such position (assuming that there is an opposite force on the lower chuck—which would be caused by a can sandwiched, or clamped, between the upper and lower chucks). The handle, as will be explained below, can be rotated in the opposite direction, to direct the lower chuck back down, toward the lower mounting plate 29.

The upper end handling subassembly includes upper chuck 48 which includes lower surface 88 and upper axle opening 89. The lower surface is configured to matingly engage the upper cap 402 of the can which is resting on the upper outwardly directed flange of the can. The upper chuck is configured to releasably maintain the upper cap in the desired orientation and to allow for the rotation of the can about its central axis.

Figure 3:
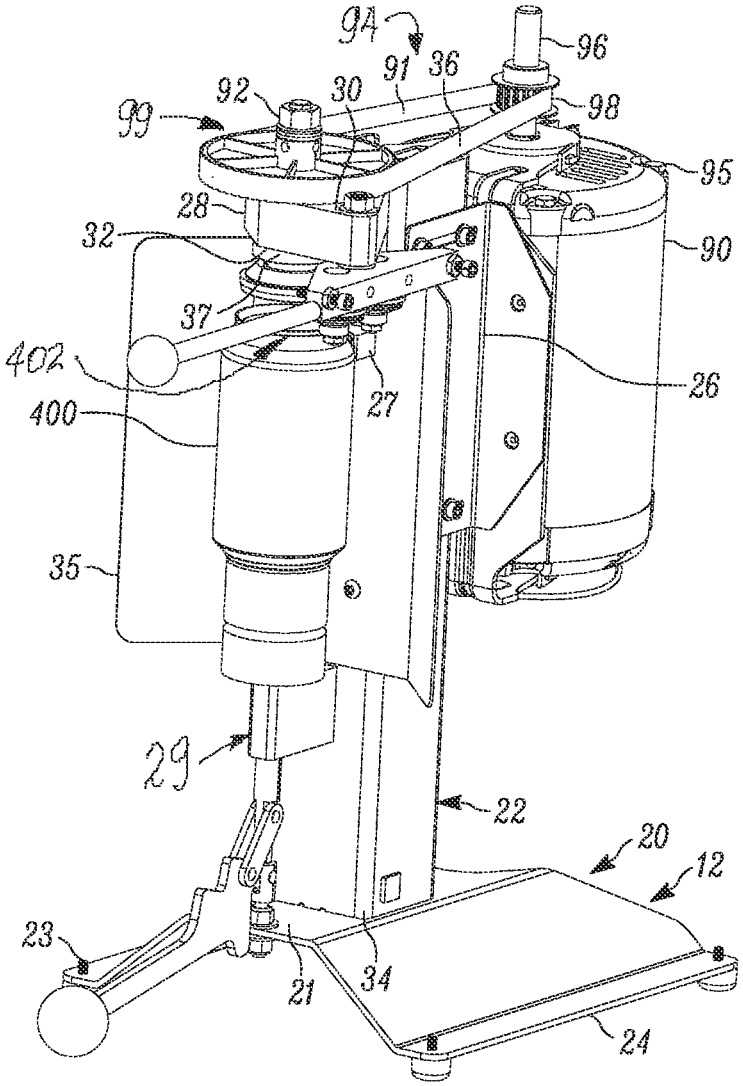
FIG. 3 of the drawings is a front, side perspective view of the can seaming apparatus, showing, in particular, a cover removed and exposing the transmission system.

The can driving assembly 16 is shown in FIG. 3 as comprising motor 90, chuck axle 92 and transmission system 94. The motor 90 is mounted in a vertical orientation on the motor mount 26, on a back surface thereof. The motor 90 includes housing 95 and axle 96, which axle extends substantially vertically from the housing 95. The chuck axle 92 extends through the upper mounting plate 28 and is coupled to the upper axle opening 89. The transmission system 94 includes motor pulley 98, can pulley 99 and belt 91. The motor pulley 98 is fixed to the axle 96 of the motor with the can pulley coupled to the chuck axle 92. The belt rotatably couples the two pulleys. The two pulleys are sized so that the motor rotates at a faster rate than the can. Of course the precise ratio between the two can be varied and can be determined through different means for different types of cans and the like.

The seaming assembly 18 is shown in FIGS. 5 through 10 as comprising roller frame 100, roller frame pivot axle 102, rotation actuator 104, first roller 106, second roller 108 and rotation limiting assembly 109. The roller frame 100 includes outer end 110 and inner end 112, with a pivot mount opening 114 positioned therebetween. The roller frame 100 further includes first roller mount 116 and second roller mount 118 (which each comprise openings configured to receive an axle). In the configuration shown, the pivot mount opening 114, the first roller mount 116 and the second roller mount 118 are all parallel and offset from each other (and also parallel to the rotation of the upper chuck. In the configuration shown, the first and second roller mounts are generally symmetrically associated with the pivot mount opening.

The roller frame pivot axle 102 extends between the pivot mount opening and the upper mounting plate so that the two are rotatably pivotable relative to each other. In the configuration shown, the roller frame and the pivot axle are to the right hand side of the upper chuck.

The rotation actuator 104 includes first end 120 and second end 122. The rotation actuator generally comprises a substantially linear handle member, with a grasping member at the end thereof (in the configuration shown, a sphere).

The first roller 106 has a roller mount axle 128 that is coupled to the first roller mount 116, defining an axis of rotation 124. The first roller 106 includes outer periphery 126 which includes a configuration that is structurally designed to form a desired seam portion of the can seam. The second roller 108 has a roller mount axle 138 that is coupled to the second roller mount 118, defining an axis of rotation 134. The second roller includes outer periphery 136 that includes a configuration that is structurally designed to form a desired seam portion of the can seam. It will be understood that the outer periphery 126 and 136 are often different in configuration, and are applied (or contacted with) the can to cooperatively, and sequentially form the can seam. The first and second rollers are on opposite sides of the roller frame pivot axle.

It will be understood that the roller mount axles 128 and 138 are designed so as to be insertable into the first and second roller mounts to a desired depth, thus, the "z" or height position of the first and second rollers can be altered relative to the roller frame.

The rotation limiting assembly 109 comprises clockwise stop member 140 and counterclockwise stop member 142.

The clockwise stop member 140 is positioned near the outer end 110 of the roller frame, and, comprises a threaded fastener that extends into the roller fame generally perpendicular to the roller mount axles 128, 138. It will be understood that the head of the fastener can interface with the lower limit surface 37 of the upper mounting plate 28. Similarly, the counterclockwise stop member 142 is positioned near the inner end 112 of the roller frame, and, comprises a threaded fastener that extends into the roller frame generally perpendicular to the roller mount axles 128, 138 (and generally parallel to and spaced apart from the clockwise stop member 140). The counterclockwise stop member 142 interfaces with the lower limit surface 37 of the upper mounting plate.

It will be understood that the clockwise stop member precludes further pivoting of the roller frame relative to the upper mounting plate due to the interface thereof with the lower limit surface 37 of the upper mounting plate. Similarly, the counterclockwise stop member precludes further pivoting of the roller frame relative to the upper mounting plate due to the interface thereof with the lower limit surface 37 of the upper mounting plate. In the configuration shown, the roller frame is structurally configured to rotate through approximately 180° of rotation, while it will be understood that variations are contemplated wherein the rotation is greater or less than 180°, for example, in other configurations, the rotation is preferably approximately 120°. Again, variations are contemplated which may be greater or less than 120°. It will be understood that these variations can be accomplished by moving the axis of rotation of the first and second rollers relative to the pivot axle, as well as optionally adjusting the rotation limiting assembly. Preferably, the rotation is on the order of between 60° and 200°, and more preferably between 110° and 185°, while not being limited thereto.

In operation, the user first is provided with the can seaming apparatus 10. The user next obtains a can 400 in an unassembled condition. The can is positioned on the upper surface of the lower chuck. The configuration of the upper surface of the lower chuck, and including the chamfered outer rim provides assistance and urges or otherwise directs the can into the proper orientation. It will be understood that different chucks can be employed depending on the size or configuration of a can. It is contemplated that a set of lower chucks may be provided or available to handle different configurations of cans.

At the same time, the can is inserted into the can region of the apparatus, and pushed or directed into contact with the inner edge 33 of the can forming bracket 27. It will be understood that when pressed against the inner edge 33, the can is slightly out of alignment relative to the axis 53 (in the configuration shown).

Once positioned, the overcenter handle is rotated by grasping the arm. In particular, as the arm rotates, the lower chuck is directed in an upward direction, along with the can. Eventually, the can lid contacts the lower surface of the upper chuck. As the position of the inner edge 33 places the can close enough to the axis 53, the upper chuck pulls the can away from the inner edge 33 and into alignment with axis 53. When in alignment, the can sides are spaced apart from the inner edge 33, preferably, so that when rotating, the can stays spaced apart from the inner edge 33 so it is not marred or destroyed. Such a configuration allows for simple positioning during attachment of the can to ensure that it can easily be positioned in the desired orientation. At the same time, the can forming bracket 27 does not mar or generally contact the rotating can. In other configurations, the bracket 27 may remain in contact with the can when aligned. In such configurations, the bracket may include rollers or other structures which limit marring and friction between the components.

At this time, the arm reaches a position where the linkages are all generally axial, and further movement directs the lever portion of the overcenter handle in an overcenter position, thereby locking the overcenter mechanism is locked in position.

In this locked position, the can is firmly sandwiched (or clamped) between the upper and lower chucks and substantially precluded from movement relative to either of the chucks. It will be understood that there may be a variation in the dimensions of a can. In such a configuration, the biasing member may be sufficient to accommodate the variation in dimensions. It will be understood that other lower chucks may be swapped in and out to accommodate differently sized cans.

In other such instances, it may be necessary to make an adjustment to the lower can positioning subassembly. In particular, it may be that in the overcenter locked configuration, the distance between the upper and lower chuck is greater than the can to such an extent that the can is not clamped tightly enough by the upper and lower chucks. In other configurations, it may be that the distance between the upper and lower chucks is not as large as the can. In such an instance, attempted clamping of the can between the upper and lower chucks can result in damage to the can. As elaborated upon above, the biasing member or spring (such a wave spring) that can be positioned within the lower chuck further aids adjustability. This can take up the difference in can height at the maximum and minimum tolerances, without requiring readjustment of the lower chuck. Additionally, the lower assembly may have some elasticity to facilitate adjustment for can height within certain limits.

In either instance where the upper and lower chucks are not configured properly to clamp the can, the lower can positing subassembly can be adjusted. Specifically, the lower clamp rod can be moved relative to the lower mounting plate. Next, the adjustment mechanism can be altered which can direct the lower clamp rod up or down, to selectively increase or decrease the upward movement of the lower chuck relative to the upper chuck. Once the desired adjustment is reached, the locking screw can be tightened, which locks the lower clamp rod to the lower mounting plate.

Once the can is clamped, and in an engaging configuration, the can is spun on its central axis 53 along with the upper and lower chucks. To spin the can, the motor is actuated. The power of the motor rotates the motor pulley which transfers the power via the belt to the can pulley. The can rotates at a predetermined speed based on the relative size of the motor pulley and the cam pulley. It will be understood that a number of different configurations are contemplated, including constant speed motors and variable speed motors. Additionally, it will be understood that the pulleys may be replaced with differently sized pulleys so as to alter the speed at which the can spins about its axis.

Once the can reaches sufficient speed, the top of the can is crimped to the can to form the double can seal. This is achieved by first directing the first roller into contact with the can and the top, to initiate the formation of the double can seal. Next, the second roller is directed into contact with the can and the top to finish the double can seal. In more detail, the user first grasps the handle of the seam forming subassembly and rotates the lever thereof about the roller frame pivot axle, in a first, clockwise direction. Eventually, the first roller comes into contact with the can and initiates the crimping of the top of the can with the can. So that the roller does not apply too great a force on the can, the stop member eventually contacts the clockwise stop member 140 precluding further rotation.

Once the first crimping deformation is applied by the first roller, the handle is rotated in the opposite direction to direct the first roller away from the can. The rotation of the handle continues until the second roller contacts the can and the can top. As the second roller is further rotated, the roller applies the crimping deformation to complete the double can seal. The rotation of the roller is precluded when the counterclockwise stop roller contacts the lower limit surface 37.

Once the second roller has applied the final crimping step, the second roller can be rotated about the roller frame pivot axle to move the second roller away from the can. The handle can be moved so that the roller frame is in a position where neither the first roller or the second roller are in contact with the can. At such time, the can is fully formed and sealed.

It will be understood that the spacing of the first and second roller relative to the roller frame pivot axle and the upper chuck is such that as rotated, the rollers contact the can at tangential points so as to minimize the force necessary to be exerted onto the can, and also to limit undesired over-deformation of the can. Of course, the rollers can be positioned relative to the roller frame pivot axle so as to achieve the desired forces onto the can and the desired rotation of the roller frame relative to the upper mounting plate.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A can seaming apparatus comprising:

a frame;

a can handling assembly including a lower chuck structurally configured to retain a lower rim of a blank of a can, and an upper chuck structurally configured to retain an upper cap of the can, the lower chuck being movable toward and away from the upper chuck;

a motor rotatably coupled to at least one of the upper chuck and the lower chuck; and a seam forming assembly having a roller frame pivotably coupled to the frame through a roller frame pivot axle, a first roller rotatably coupled to the roller frame about a first roller axis spaced apart from the roller frame pivot axle and a second roller rotatably coupled to the roller frame, with the first and second rollers being on opposite sides of the roller frame pivot axle;

wherein the seam forming assembly further includes a rotation limiting assembly configured to limit the rotation of the roller frame about the roller frame pivot axle, and, including a clockwise stop member located on and moving with the roller frame outboard of the first roller so that the first roller is between the clockwise stop member and the roller frame pivot axle, and a counterclockwise stop member located on and moving with the roller frame outboard of the second roller so that the second roller is between the counterclockwise stop member and the roller frame pivot axle, the clockwise stop member limiting rotation in a clockwise direction and the counterclockwise stop member limiting rotation in a counterclockwise direction, the clockwise stop member and the counterclockwise stop member being adjustable.

2. The can seaming apparatus of claim 1 further comprising a lower can handling subassembly including an overcenter mechanism to lock the lower chuck into an engaging configuration.

3. The can seaming apparatus of claim 2 wherein the overcenter mechanism includes an overcenter handle which is coupled through linkages to the lower chuck, wherein the overcenter handle can be rotated relative to the linkages into the engaging configuration.

4. The can seaming apparatus of claim 3 wherein the overcenter mechanism further includes an adjustment mechanism structurally configured to adjust the position of the lower chuck relative to the upper chuck in the engaging configuration.

5. The can seaming apparatus of claim 1 wherein the motor is operably coupled to the upper chuck, to in turn, facilitate rotation thereof.

6. The can seaming apparatus of claim 1 wherein the upper chuck is rotatably coupled to the frame, in a fixed position.

7. The can seaming apparatus of claim 1 wherein the lower chuck and the upper chuck have a collinear axis of rotation.

8. The can seaming apparatus of claim 1 wherein the first roller axis, a second roller axis and the roller frame pivot axle are parallel to each other.

9. The can seaming apparatus of claim 1 further including a rotation actuator extending from the roller frame.

10. The can seaming apparatus of claim 9 wherein the rotation actuator comprises a handle member.

11. The can seaming apparatus of claim 1 wherein the roller frame, the first roller and the second roller are substantially symmetrical about an axis that extends through the roller frame pivot axle.

12. The can seaming apparatus of claim 1 wherein each of the clockwise stop member and the counterclockwise stop member comprise threaded fasteners extending through the roller frame perpendicular to the roller frame pivot axle, whereupon threading of the same relative to the roller frame one of increases or decreases a pivoting of the roller frame about the roller frame pivot axle.

13. The can seaming apparatus of claim 1 wherein the frame comprises a base with a central region, a first foot and a second foot extending from the central region, and, a central beam extending upwardly from the central region.

14. The can seaming apparatus of claim 13 wherein the motor is mounted to the central beam.

15. A method of operating the can seaming apparatus of claim 1, the method comprising the steps of:

providing the can blank and the top cap;

positioning the can blank on the lower chuck;

positioning the top cap on the can blank;

raising the lower chuck so that the top cap engages the upper chuck and the lower chuck reaches an engaging configuration;

locking the lower chuck in the engaging configuration;

actuating the motor so as to rotate the lower and upper chucks and the can blank and top cap about an axis of rotation;

pivoting the roller frame in a first direction to engage the can blank and top cap, with the first roller, to, in turn, deform at least one of the can blank and the can top;

pivoting the roller frame in a second direction to engage the can blank and top cap with the second roller, to, in turn, deform at least one of the can blank and the can top;

removing the can blank and the top cap from the upper and lower chucks.

16. The method of claim 15 wherein the first roller and the second roller pivot about the axis of rotation of the roller frame pivot axle.

17. The method of claim 15 wherein the first roller and the second roller are spaced apart from each other to allow for approximately between 60° and 200° of pivoting of the roller frame about an axis of rotation of the roller frame.

* * * * *